United States Patent [19]

Brown

[11] Patent Number: 4,758,193

[45] Date of Patent: Jul. 19, 1988

[54] COLOR CATHODE RAY TUBE HAVING IMPROVED INTERNAL MAGNETIC SHIELD

[75] Inventor: Richard I. Brown, Seneca Falls, N.Y.

[73] Assignee: North American Philips Consumer Electronics Corp., New York, N.Y.

[21] Appl. No.: 58,085

[22] Filed: Jun. 4, 1987

Related U.S. Application Data

[62] Division of Ser. No. 783,885, Oct. 3, 1985.

[51] Int. Cl.[4] ..... H01J 29/06

[52] U.S. Cl. ..... 445/1; 313/402; 313/479

[58] Field of Search ..... 313/402, 479; 72/334; 445/49, 22, 1

[56] References Cited

U.S. PATENT DOCUMENTS 2,825,129 3/1958 Hempel ..... 72/334
4,622,490 11/1986 Benway ..... 313/402

FOREIGN PATENT DOCUMENTS 858 1/1979 Japan ..... 313/479
25157 2/1979 Japan ..... 313/402

*Primary Examiner*—Kenneth J. Ramsey
*Attorney, Agent, or Firm*—John C. Fox

[57] ABSTRACT

Internal magnetic shield for color television picture tube has a pair of slot-shaped openings, facing each other above and below the Z axis, and an oblong-shaped aperture surrounding the Z axis, having a length-to-width ratio of about 1.7 to 2.1.

1 Claim, 2 Drawing Sheets

COLOR CATHODE RAY TUBE HAVING IMPROVED INTERNAL MAGNETIC SHIELD

This is a division, of application Ser. No. 783,885, filed Oct. 3, 1985.

BACKGROUND OF THE INVENTION

This invention relates to color cathode ray tubes having aperture masks, and more particularly relates to improved internal magnetic shields for such tubes.

Color cathode ray tubes for color television (color picture tubes) employing aperture masks are known to be sensitive to external magnetic fields, especially the earth's magnetic field, which can undesirably influence the trajectories of the electron beams, causing shifting and distortion of the screen raster, as well as degradation of color purity and convergence. For example, shifting of a beam trajectory to the right or left will result in a beam landing error in a tube with vertically oriented phosphor stripes. That is, the beam will land to the right or left of the intended landing area on the stripe.

For acceptable performance, therefore, such tubes must have effective shielding from these magnetic fields, and it has become conventional practice to incorporate internal magnetic shields into color picture tubes for this purpose.

Because the effect of the earth's magnetic field depends upon the location and orientation of the tube, optimum shielding requires the ability to remagnetize the shield to realign the magnetic domains after the tube has been moved. Accordingly, these shields are customarily fabricated from a soft magnetic material, such as low carbon steel, enabling ready remagnetization each time the television set is turned on.

The shape of the shield is in general dictated by the desire to have as much of the tube volume shielded as possible, without having the shield interfere with the tube's operation. For example, extending the shield too far back into the funnel risks interference with the magnetic deflection field for the electron beams, as well as physical interception or "clipping" of the deflected beams. In addition, cost considerations dictate as simple a shape as possible.

In Japanese patent No. 52-18165, the shield is composed of two curved sheets of magnetic material, said to make processing, storing, transportation and assembly convenient and easy. In U.S. Pat. No. 3,867,668, a similar internal shield is shown, but in addition an external shield is employed to cover the gaps created by the opening between the two curved sheets "to provide complete shielding".

Recently, despite their complex shapes, bowl-shaped internal magnetic shields have been readily formed by a process in which a foil sheet of shielding material is forced over an inverted bowl-shaped mold, resulting in the material being stretched and crimped into the desired shape.

It is customary to describe the effect of the earth's magnetic field on beam landing in terms of two components; the east-west effect, determined by a transverse horizontal field, and the north-south effect, determined by an axial horizontal field. The magnitude of these effects is the difference between the beam landing errors in the east and west-facing directions, and the north and south-facing directions, respectively. It is also customary to describe the tube's surface in terms of the face of an analog clock. Thus, the top is 12 o'clock, the bottom is 6 o'clock, the right side (as seen by the viewer) is 3 o'clock and the left side is 9 o'clock.

In one recent design, shielding of the east-west effect is reported to be improved by introducing triangular-shaped openings, so-called "balancing windows", into the 6 and 12 o'clock sides of the internal shield. (Toshiba Product Information sheet). The shield is fabricated from two flat sheets of steel, which are cut to form the desired outlines and openings, subjected to a series of straight bends to form the desired shapes, and assembled. While such improved shielding is desirable, the added costs associated with the forming and assembling of these shields is a serious concern in the present cost-competitive environment.

Accordingly, it is an object of the invention to provide improved internal magnetic shields for color tubes which exhibit improved shielding and which can be readily fabricated using present manufacturing techniques.

SUMMARY OF THE INVENTION

In accordance with the invention, an improved internal magnetic shield is provided for a color tube comprising a bowl-shaped structure having at least one slot-shaped opening in both the 6 and 12 o'clock sides of the shield, each slot aligned in the direction of the axis of rotation or Z axis of the tube, and a large aperture surrounding the Z axis for passing the tube's electron beams.

In accordance with a preferred embodiment, there is a pair of slots centrally located and facing each other above and below the Z axis in the 6 and 12 o'clock sides of the shield.

In accordance with another aspect of the invention, such an improved shield is fabricated by first cutting slots into a foil sheet of soft magnetic material, such as low carbon steel, and then forcing the sheet over a bowl-shaped form to simultaneously stretch and crimp the sheet into a bowl-shaped structure. Subsequently, an aperture is cut into the shield.

DESCRIPTION OF THE PREFERRED EMBODIMENT

Figure 1:
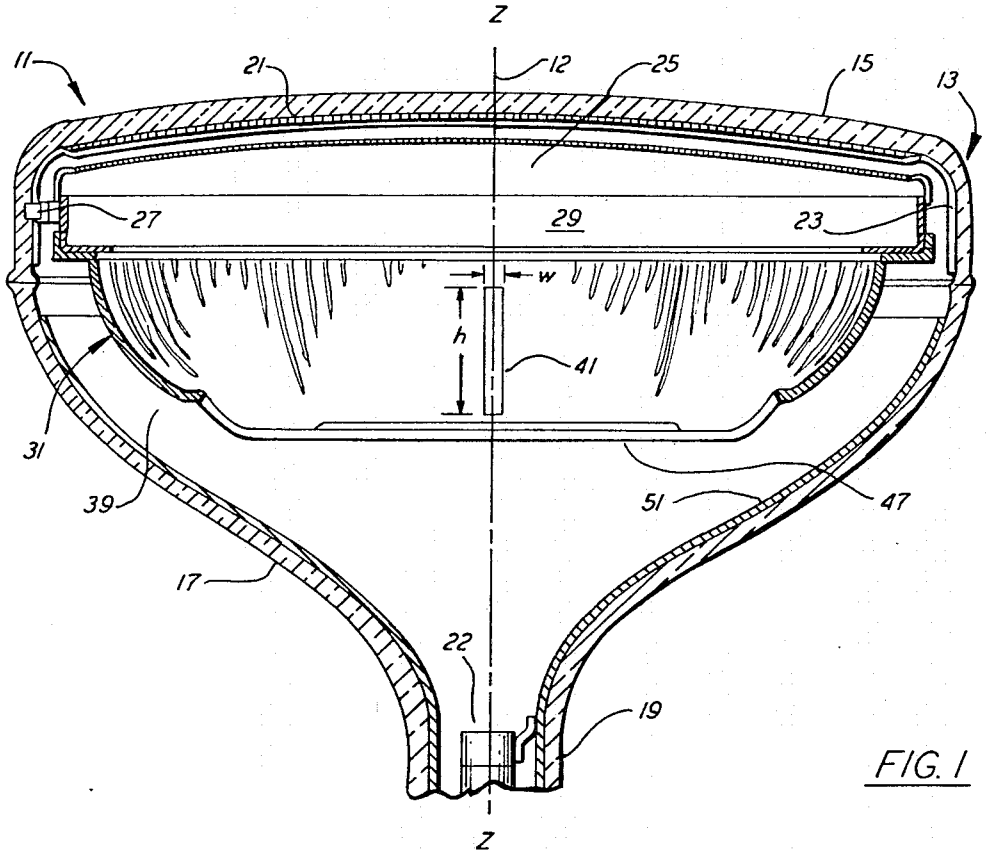
FIG. 1 is a sectioned elevation view of a color picture tube incorporating an improved internal magnetic shield according to the invention.

Referring now to FIG. 1, there is shown a color cathode ray tube for color television (color picture tube) 11, including glass envelope 13 comprising an integration of face panel 15, funnel 17 and neck 19 regions. Disposed on the interior surface of face panel 15 is cathodoluminescent screen 21, consisting of an array of discrete phosphor elements. Positioned in the neck 19 is mount 22 including an electron gun for generating and directing three electron beams to screen 21. Positioned adjacent screen 21 is a multi-apertured mask 25 for directing the electron beams to the desired phosphor elements on the screen. Aperture mask 25 is supported by frame member 29, which is in turn supported by studs 27 embedded in the sidewall of panel 15. Attached to mask frame 29 is internal magnetic shield (IMS) 31 comprised of bowl-shaped structure 39 defining superjacent slots 41 in the centers of facing top and bottom sidewalls thereof, aligned with the Z axis of the tube, and also defining aperture 47 surrounding the Z axis.

As can be seen from FIG. 1, the bowl-shaped structure 39 of shield 31 extends from the periphery of the mask 25 downward along the funnel 17 toward the mount 22, generally following the contour of the funnel wall, until it terminates in a mid-region between the mask and mount to define aperture 47. While a further extension of the shield would result in improved shielding, it would also present the risk of interference with the magnetic beam deflection field produced by external deflection means (not shown) positioned in the transition region between the funnel and the neck, as well as actual physical interception (clipping) of the electron beams.

Figure 2:
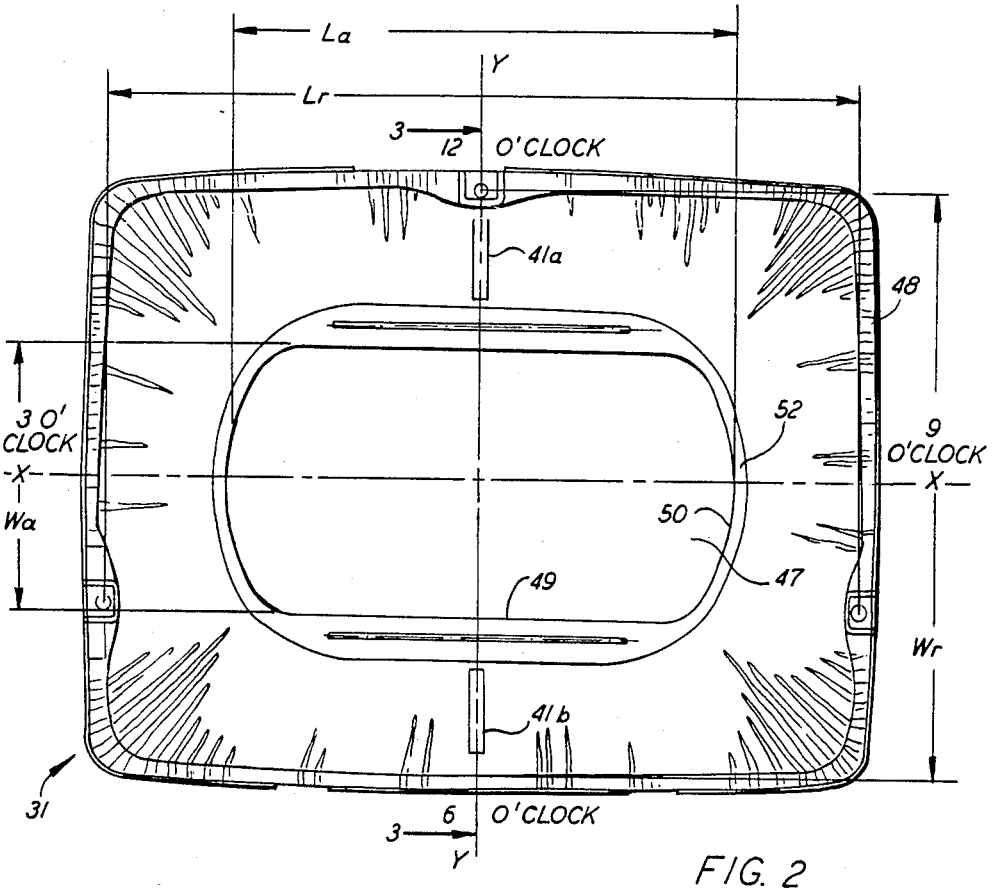
FIG. 2 is a plan view of the shield of FIG. 1 as seen from the rear, showing the slots and the shield aperture.

Referring now to FIG. 2, the shield 31 is seen in plan view from the rear or mount end of the tube, as viewed along the Z axis. In accordance with the conventional practice of labeling regions of the tube as though the screened panel were the face of an analog clock, the top, left side, bottom, and right side of the shield are labeled the 12, 3, 6 and 9 o'clock sides, respectively. As can be seen, the slots 41*a* and 41*b* are located in the centers of the 6 and 12 o'clock sides.

The slots may also be located off-center, for example, within a central region of the 6 and 12 o'clock sides, this region defined as extending up to 40 percent of the length La of the aperture. There may also be more than one slot in a sidewall, but preferably there will be the same number of slots in each sidewall. In addition, the facing slots need not be superjacent as shown, but may be displaced relative to one another, within the central region defined.

The slots have a height h which is from about 50 to 95 percent of the height Hs of the shield from the rim 48 to the straight edge 49 of the aperture 47, and a width w which is from about 1 to 10 percent of the length Lr of the shield at the rim 48.

Figure 3:
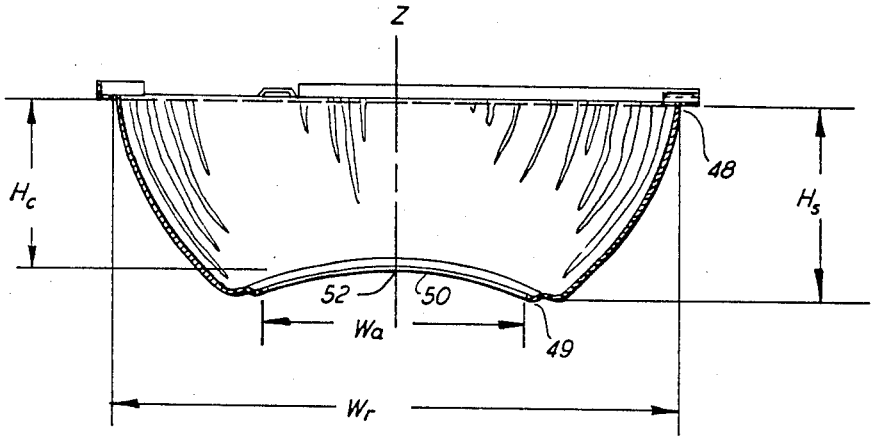
FIG. 3 is a side view of the shield of FIG. 1, showing the edge contour of one end region of the shield aperture.

The aperture 47 is oblong-shaped, having a length-to-width ratio of from about 1.7 to 2.1, and having a central region defined by straight edges 49 and two end regions defined by curved edges 50. As may be seen more clearly in FIGS. 1 and 3, the central region of the aperture lies in a plane normal to the Z axis, while the end regions lie in upwardly curving surfaces, resulting in the curved edge profile seen in FIG. 3.

The aperture has a width Wa which is from about 49 to 51 percent of the width Wr of the shield at the rim 48, and a length La which is from about 65 to 69 percent of the length Lr. In addition, the amount of upward curvature of the end regions of the aperture, resulting from the intersection of the bowl-shaped sidewalls with the oblong-shaped aperture, is indicated by the height Hc of the shield from the rim 48 to the outer point 52 of curved edge 50, and this height Hc may range from about 85 to 90 percent of the height Hs.

Within the above ranges, the aperture has a larger length-to-width ratio than the aperatures of certain prior shield designs (about 2 versus 1.3). This change has the effect of improving north-south shielding, but at the expense of slightly reduced east-west shielding. East-west shielding is at least partially recovered, however, by introducing the slots into the 6 and 12 o'clock sidewalls.

By way of example, 19V mini neck color tubes having a shield of the invention and a prior art shield were fabricated and compared for registration differences. The shield of the invention was as shown in the sidewalls, and an oblong-shaped aperture with upwardly curving end regions, with the following dimensions in inches: Hs=4.0, Lr=15.0, Wr=10.9, Hc=3.75, Wa=5.37, La=10.75, w=0.3, and h=3.9. The prior art shield had no slots and its aperture was entirely located in a plane normal to the Z axis, and had the following dimensions: Hs=3.0, Lr=15.0, Wr=10.9, Wa=7.4, and La=9.6. Registrations (difference between stripe location and actual beam landing location; also known as beam landing error) were measured on several sample tubes for each type of shield and averaged. Measurements were taken at the four corners of the screen for each sample tube oriented successively in the west, south, east, north and west directions. Registration differences between north and south facing orientations averaged about 0.6 mils or less for the inventive shield versus about 1.2 mils for the prior art shield. Registration differences between east and west facing orientations averaged about 0.6 mils for the inventive shield versus about 0.5 mils for the prior art shield. The significant improvement in north-south shielding at the expense of a slight decrease in east-west shielding resulted in a beneficial correction of the effects of external magnetic fields, and a consequent overall improvement in tube performance.

In accordance with another aspect of the invention, the shield is fabricated from a foil sheet of soft magnetic material, such as low carbon steel. The sheet is shaped by forcing it over a mold, resulting in simultaneously stretching and crimping it into the desired shape. The crimps are represented in the drawings by the randomly distributed looped and wavy lines.

The slots are preferably formed before shaping (such as by cutting or punching) because after shaping the slots lie in a curved surface and forming in such a surface is more difficult than in a flat surface. Because the slots are located in an area of the foil which undergoes considerable stretching during shaping, it is important that the slots adhere to the dimensional and other limitations set forth herein, in order to avoid tearing of the foil or deformation of the slots or both, during shaping. For the same reasons, the aperture is preferably formed after shaping.

While there have been shown and described what are at present considered to be the preferred embodiments of the invention, it will be obvious to those skilled in the art that various changes and modifications may be made therein without departing from the scope of the invention as defined by the appended claims.

I claim:

1. A method of producing an internal magnetic shield for a color cathode ray tube, the shield comprising a bowl-shaped structure having a rim and a sidewall extending from the rim to define an aperture for passing an electron beam, the method comprising:

first forming at least one pair of slots in a foil sheet of soft magnetic material; then forcing the sheet over a bowl-shaped mold to stretch the sheet into a bowl-shaped structure; followed by forming an aperture in the structure, the resulting structure having an axis designated the Z axis, and top, right side, bottom and left side surfaces surrounding the Z axis, the surfaces designated the 12, 3, 6 and 9 o'clock surfaces respectively;

the first slot located in the central portion of the 12 o'clock side above the Z axis, and the second slot located in the central portion of the 6 o'clock side below the Z axis and facing the first slot;

the aperture defined by approximately straight 6 and 12 o'clock edges, and by outwardly and upwardly curving 3 and 9 o'clock edges, to form an oblong shaped aperture having a central and two side portions, the central portion of which lies in a plane normal to the Z axis, and the side portions of which lie in surfaces upwardly curving from the normal plane;

the shield having a height from the rim to the straight edges of the aperture Hs and a length at the rim Lr, and the slots having a height h which is from about 50 to 95 percent of Hs, and a width w which is from about 1 to 10 percent of Lr.

* * * * *